US009136636B2

(12) United States Patent
Zhang et al.

(10) Patent No.: US 9,136,636 B2
(45) Date of Patent: Sep. 15, 2015

(54) CONNECTOR

(71) Applicants: Tyco Electronics (Shanghai) Co. Ltd., Shanghai (CN); Tyco Electronics Japan G.K., Kanagawa-ken (JP); Tyco Electronics AMP Korea Ltd.; Tyco Electronics Holdings (Bermuda) No. 7 Limited, Pembroke (BM)

(72) Inventors: Shihao Zhang, Shanghai (CN); Jung-Hoon Kim, Kyungsangbuk-Do (KR); Xiang Xu, Shanghai (CN); Huei-Shun Feng, Taipei (TW); Wei Yao, Shanghai (CN); Hiroshi Shirai, Kanagawa-ken (JP); Cheng-Hsuan Yu, Taipei (TW)

(73) Assignees: Tyco Electronics (Shanghai) Co. Ltd., Shanghai (CN); Tyco Electronics AMP Korea Ltd., Kyungsangbuk-Do (KR); Tyco Electronics Holdings (Bermuda) No. 7 Limited, Pembroke (BM); Tyco Electronics Japan G.K., Kanagawa-Ken (JP)

( * ) Notice: Subject to any disclaimer, the term of this patent is extended or adjusted under 35 U.S.C. 154(b) by 86 days.

(21) Appl. No.: 14/014,090

(22) Filed: Aug. 29, 2013

(65) Prior Publication Data

US 2014/0065889 A1 Mar. 6, 2014

(30) Foreign Application Priority Data

Aug. 29, 2012 (CN) ..... 2012 2 0432784 U

(51) Int. Cl.
*H01R 13/516* (2006.01)
*H01R 43/24* (2006.01)

(52) U.S. Cl.
CPC ..... *H01R 13/516* (2013.01); *H01R 43/24* (2013.01)

(58) Field of Classification Search
CPC ..... H01R 13/6471; H01R 23/7073; H01R 23/688
See application file for complete search history.

(56) References Cited

U.S. PATENT DOCUMENTS

| | | | | |
|---|---|---|---|---|
| 6,350,134 | B1 * | 2/2002 | Fogg et al. | 439/79 |
| 6,540,559 | B1 * | 4/2003 | Kemmick et al. | 439/607.05 |
| 6,863,549 | B2 * | 3/2005 | Brunker et al. | 439/108 |
| 6,935,870 | B2 * | 8/2005 | Kato et al. | 439/108 |
| 6,953,351 | B2 * | 10/2005 | Fromm et al. | 439/101 |
| 6,969,268 | B2 * | 11/2005 | Brunker et al. | 439/108 |
| 7,090,540 | B2 * | 8/2006 | Masumoto et al. | 439/660 |
| 7,270,570 | B1 * | 9/2007 | Hamner et al. | 439/607.04 |
| 7,303,410 | B2 * | 12/2007 | Saito | 439/108 |
| 7,344,412 | B2 * | 3/2008 | Sato | 439/607.28 |
| 7,435,107 | B2 * | 10/2008 | Masumoto et al. | 439/79 |
| 7,448,884 | B2 * | 11/2008 | Kato et al. | 439/108 |
| 7,462,059 | B2 * | 12/2008 | Saito et al. | 439/397 |
| 7,485,008 | B1 * | 2/2009 | Yi et al. | 439/660 |
| 7,632,145 | B1 * | 12/2009 | Lin et al. | 439/607.32 |
| 7,674,118 | B2 * | 3/2010 | He | 439/108 |

(Continued)

*Primary Examiner* — Ross Gushi
(74) *Attorney, Agent, or Firm* — Barley Snyder

(57) ABSTRACT

A connector is provided that includes an insulation body and a plurality of contacts. The insulation includes a plurality of contact receiving grooves arranged in a row and the plurality of contacts are disposed in the plurality of contact receiving grooves. The plurality of contacts include a first group of contacts and a second group of contacts with a first pair of differential signal contacts and a second pair of differential signal contacts disposed at both sides of the first group of contacts, respectively.

17 Claims, 6 Drawing Sheets

(56) References Cited

U.S. PATENT DOCUMENTS

| | | | | |
|---|---|---|---|---|
| 7,824,220 | B2 * | 11/2010 | Chen | 439/607.35 |
| 7,833,065 | B2 * | 11/2010 | Lin et al. | 439/639 |
| 7,845,961 | B2 * | 12/2010 | Zhu et al. | 439/108 |
| 7,938,659 | B1 * | 5/2011 | Zhu et al. | 439/218 |
| 8,025,532 | B2 * | 9/2011 | Nagata et al. | 439/607.4 |
| 8,033,840 | B2 * | 10/2011 | Wang et al. | 439/108 |
| 8,075,345 | B2 * | 12/2011 | Peng | 439/660 |
| 8,142,209 | B2 * | 3/2012 | Zhu et al. | 439/108 |
| 8,157,599 | B2 * | 4/2012 | Wei | 439/660 |
| 8,231,410 | B2 * | 7/2012 | Tung et al. | 439/607.01 |
| 8,277,253 | B2 * | 10/2012 | Lee et al. | 439/607.32 |
| 8,323,057 | B2 * | 12/2012 | Ho | 439/660 |
| 8,419,480 | B2 * | 4/2013 | Yu et al. | 439/660 |
| 8,506,332 | B2 * | 8/2013 | Sommers et al. | 439/607.34 |
| 8,628,357 | B2 * | 1/2014 | Tai et al. | 439/660 |
| 8,636,546 | B2 * | 1/2014 | He et al. | 439/607.4 |
| 8,740,649 | B2 * | 6/2014 | Lan et al. | 439/607.4 |
| 8,747,165 | B2 * | 6/2014 | Kim | 439/660 |
| 8,801,470 | B2 * | 8/2014 | Hsueh | 439/660 |
| 8,864,526 | B2 * | 10/2014 | Kim et al. | 439/638 |
| 8,882,515 | B2 * | 11/2014 | Lv et al. | 439/79 |
| 8,894,443 | B2 * | 11/2014 | Sommers et al. | 439/607.34 |
| 8,894,451 | B2 * | 11/2014 | Shiratori et al. | 439/885 |
| 2002/0123254 | A1 * | 9/2002 | Kato et al. | 439/108 |
| 2005/0059296 | A1 * | 3/2005 | Wang | 439/541.5 |
| 2005/0272286 | A1 * | 12/2005 | Lapidot et al. | 439/108 |
| 2007/0099512 | A1 * | 5/2007 | Sato | 439/637 |
| 2009/0130873 | A1 * | 5/2009 | He | 439/108 |
| 2009/0156027 | A1 * | 6/2009 | Chen | 439/83 |
| 2009/0186528 | A1 * | 7/2009 | Chen | 439/660 |
| 2010/0167583 | A1 * | 7/2010 | Lin et al. | 439/607.01 |
| 2010/0167594 | A1 * | 7/2010 | Lee et al. | 439/660 |
| 2012/0231671 | A1 * | 9/2012 | Kim | 439/660 |
| 2012/0276777 | A1 * | 11/2012 | Lv et al. | 439/607.01 |
| 2013/0149915 | A1 * | 6/2013 | Kim et al. | 439/692 |
| 2014/0065889 | A1 * | 3/2014 | Zhang et al. | 439/660 |
| 2014/0287628 | A1 * | 9/2014 | Zhang et al. | 439/626 |

* cited by examiner

CONNECTOR

CROSS-REFERENCE TO RELATED APPLICATIONS

This application claims the benefit of the filing date under 35 U.S.C. §119(a)-(d) of Chinese Patent Application No. 201220432784.1 filed on Aug. 29, 2012.

FIELD OF INVENTION

The present invention relates to a connector and, more particularly, to a USB (Universal Serial Bus) connector compatible with Micro USB and USB 3.0 standards.

BACKGROUND

There are known USB connectors that include two independent ports generally provided for Micro USB (for example, Micro USB 2.0) and USB 3.0 standards compatibility, respectively. One port is used for a Micro USB mating connector, and the other port is for USB 3.0 mating connector.

However, since the known USB connector has two independent ports separate from each other, the overall dimensions of the known USB connector are approximately two times the size of other known USB connectors solely used for Micro USB mating connectors. Accordingly, the known USB connector is too large in the dimension, thereby increasing the cost.

The port of the known USB connector used for Micro USB mating connector includes five contacts having a pair of differential signal contacts for transmitting Micro USB signals, a power contact for supplying an electric power to the connector; a ground contact, and a detection contact. The other port used for USB 3.0 mating connector includes four contacts having two pair of differential signal contacts for transmitting USB 3.0 signals.

Furthermore, during manufacturing of the known USB connector, a bridge portion is generally positioned between adjacent longer contacts to connect the adjacent longer contacts and hold the relative position of the same. After an insulation body has been molded on the contacts, these bridge portions must be cut and removed.

However, in the prior art, these bridge portions are formed at electrical contact portions of the longer contacts which are exposed outside the insulation body. Thereby, after the bridge portion is cut and removed, a small incision is left in the contact, and an internal base material of the contact is exposed to outside elements. As a result, during corrosion resistance testing of the electrical contact portion with nitrous acid, a corrosion point may be formed at the small incision produced by cutting the bridge portion and then gradually expanded to the whole electrical contact portion of the contact, decreasing the corrosion resistance of the contact and making adverse effects on performances of the contact.

SUMMARY

The present invention has been made to overcome or alleviate at least one aspect of the above mentioned disadvantages, among others. Accordingly, a connector is provided that includes an insulation body and a plurality of contacts. The insulation includes a plurality of contact receiving grooves arranged in a row and the plurality of contacts are disposed in the plurality of contact receiving grooves. The plurality of contacts include a first group of contacts and a second group of contacts with a first pair of differential signal contacts and a second pair of differential signal contacts disposed at both sides of the first group of contacts, respectively. In another exemplary embodiment according to the present invention, the first group of contacts comprising: a power contact for supplying an electric power to the connector; a third differential signal contacts for transmitting the Micro USB signal; a detection contact for detecting a use state of the connector; and a ground contact.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EMBODIMENT(S)

Figure 1:
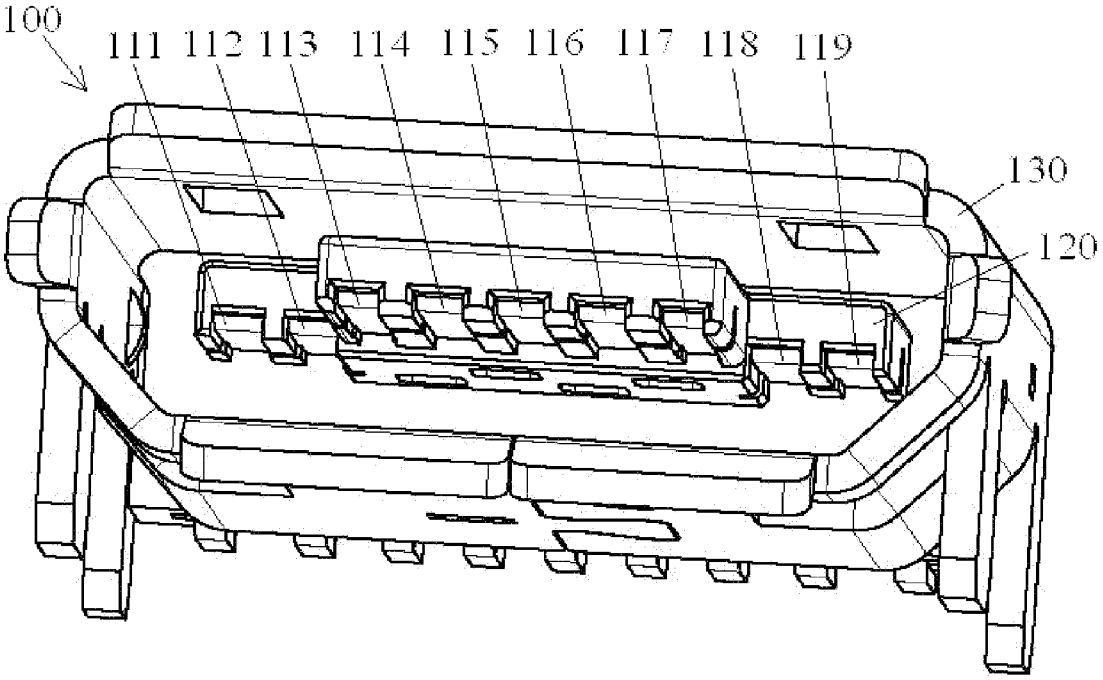
FIG. 1 is an a perspective view of a connector according to the invention.

Exemplary embodiments of the invention will be described hereinafter in detail with reference to the attached drawings, wherein the like reference numerals refer to the like elements. The present invention may, however, be embodied in many different forms and should not be construed as being limited to the embodiment set forth herein; rather, these embodiments are provided so that the present disclosure will be thorough and complete, and will fully convey the concept of the disclosure to those skilled in the art.

Figure 2:
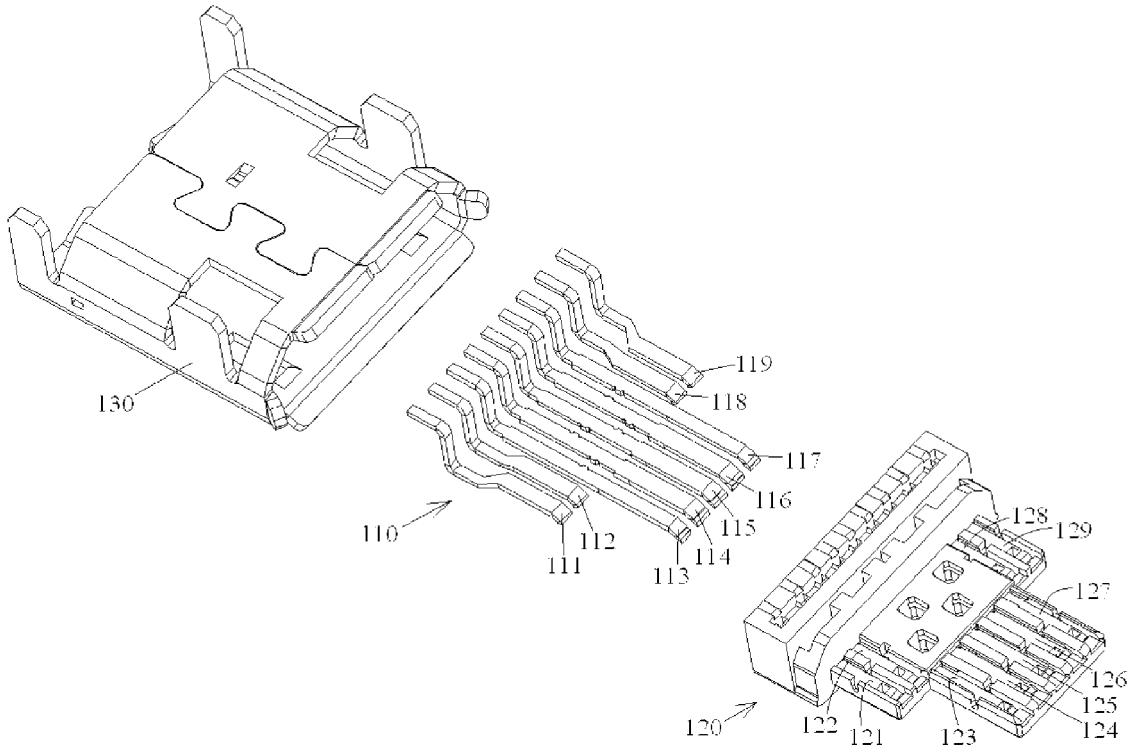
FIG. 2 is an exploded view of the connector shown in FIG. 1.

As shown in FIG. 1 and FIG. 2, a connector 100 according to the invention is shown and includes a plurality of contacts 111 to 119, an insulation body 120, and a shield 130.

Referring to FIG. 2, a plurality of contact receiving grooves 121 to 129 are formed in the insulation body 120. Please refer to FIG. 1, the plurality of contacts 111 to 119 are received in the plurality of contact receiving grooves 121 to 129, respectively, and the shield 130 is enclosed outside the insulation body 120.

Referring to FIGS. 1-2 again, the plurality of contacts 111 to 119 includes a first group of contacts 113 to 117 for transmitting a first data transmission standard signal and a second group of contacts 111, 112, 118, 119 for transmitting a second data transmission standard signal. The second group of contacts includes a first pair of differential signal contacts 111, 112 and a second pair of differential signal contacts 118, 119.

In an exemplary embodiment of the invention, the connector 100 may be a USB connector compatible with both Micro USB (for example, Micro USB 2.0) and USB 3.0 mating connectors, for example. In the shown embodiment, the plurality of contacts 111 to 119 include five contacts 113 to 117 for a Micro USB mating connector and four contacts 111, 112, 118, 119 for a USB 3.0 mating connector.

In an exemplary embodiment shown in FIGS. 1-2, two contacts 111, 112 serve as the first pair of differential signal contacts 111, 112 for transmitting USB 3.0 signals, and two contacts 118, 119 serve as the second pair of differential signal contacts 118, 119 for transmitting USB 3.0 signals.

In an exemplary embodiment shown in FIGS. 1-2, the contact 113 is served as a power contact 113 for supplying an electric power to the mixed type of USB connector. Two contacts 114, 115 are served as a third differential signal contacts 114, 115 for transmitting Micro USB signals, the contact 116 is served as a detection contact 116 for detecting an operation state of the connector, and the contact 117 is served as a ground contact 117.

As shown in FIGS. 1-2, the plurality of contacts 111 to 119 are arranged in one row and the first pair of differential signal contacts 111, 112 and the second pair of differential signal contacts 118, 119 are positioned along both sides of the first group of contacts 113 to 117, respectively. Accordingly, as compared with the known USB connector having multiple ports, the USB connector 100 omits one additional port, which reduces the size and decreasing the cost during manufacturing.

Furthermore, the two pairs of differential signal contacts 111, 112, 118, 119 carry a relative high current and, therefore, a mutual interference is prone to be happened between them. In order to effectively deter the mutual interference, in the present invention, the two pairs of differential signal contacts 111, 112, 118, 119 are arranged at outmost sides of the one row of the plurality of contacts 111-119, respectively, and the two pairs of differential signal contacts 111, 112, 118, 119 are separated farthest from each other.

As shown in FIG. 2, all the contacts 113 to 117 of the first group of contacts have substantially the same length defined as a first length, and all the contacts 111, 112, 118, 119 of the second group of contacts have substantially the same length defined as a second length different from the first length. In embodiment shown in FIG. 2, the first length is larger than the second length, that is, the length of the five contacts 113 to 117 (i.e. for a Micro USB mating connector) is longer than the length of the two pairs of differential contacts 111, 112, 118, 119 (i.e. for a USB 3.0 mating connector).

Figure 3:
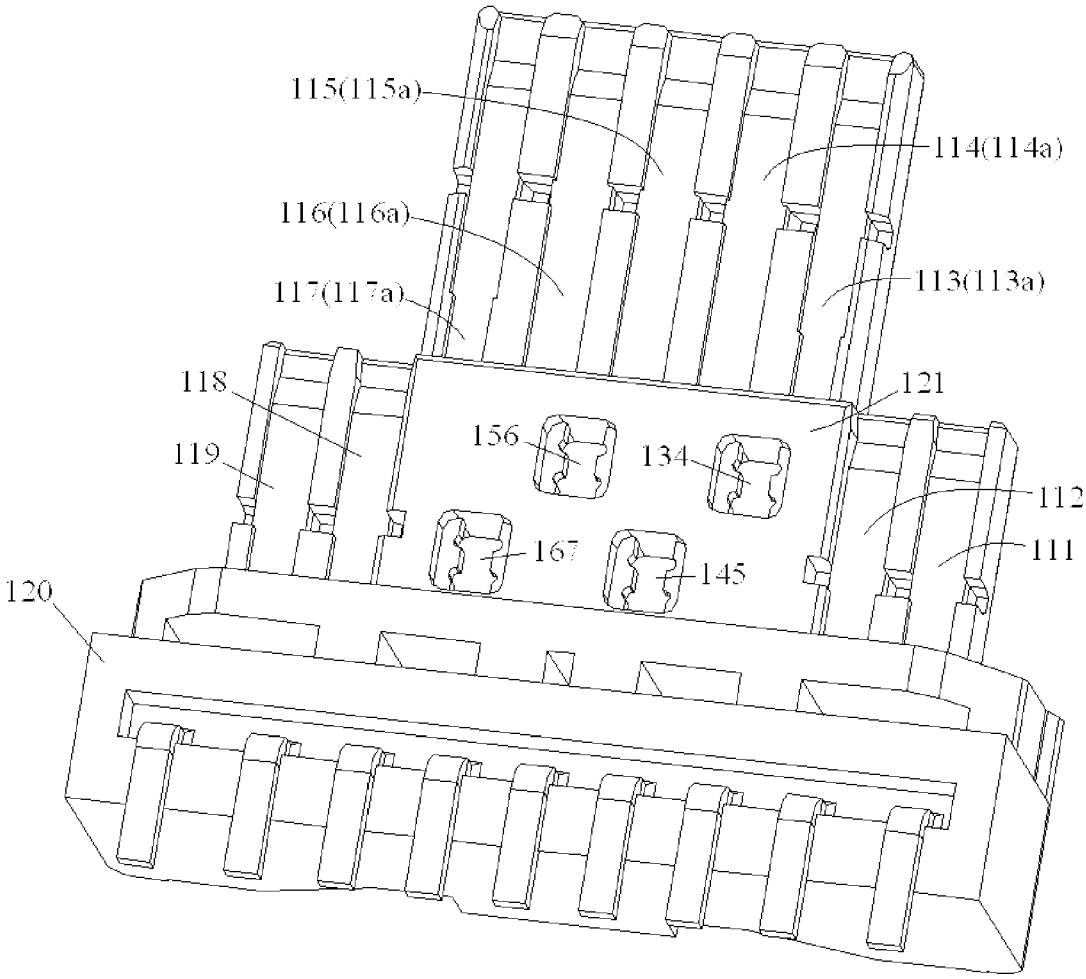
FIG. 3 is a perspective view of the connector of FIG. 1, showing an insulation body molded over a plurality of contacts and a plurality of bridge portions positioned between adjacent longer contacts of the plurality of contacts.

Now with respect to FIG. 3, the connector 100 of FIG. 1 is shown with the shield 130 being removed. The insulation body 120 has been molded over contacts 111 to 119, and a plurality of bridge portions 134, 145, 156, 167 are positioned between adjacent longer contacts 113 to 117. In the shown embodiment, the plurality of bridge portions 134, 145, 156, 167 have not been cut and removed yet. However, as shown in FIG. 4, the bridge portions 134, 145, 156, 167 between adjacent longer contacts 113 to 117 have been cut and removed.

Figure 4:
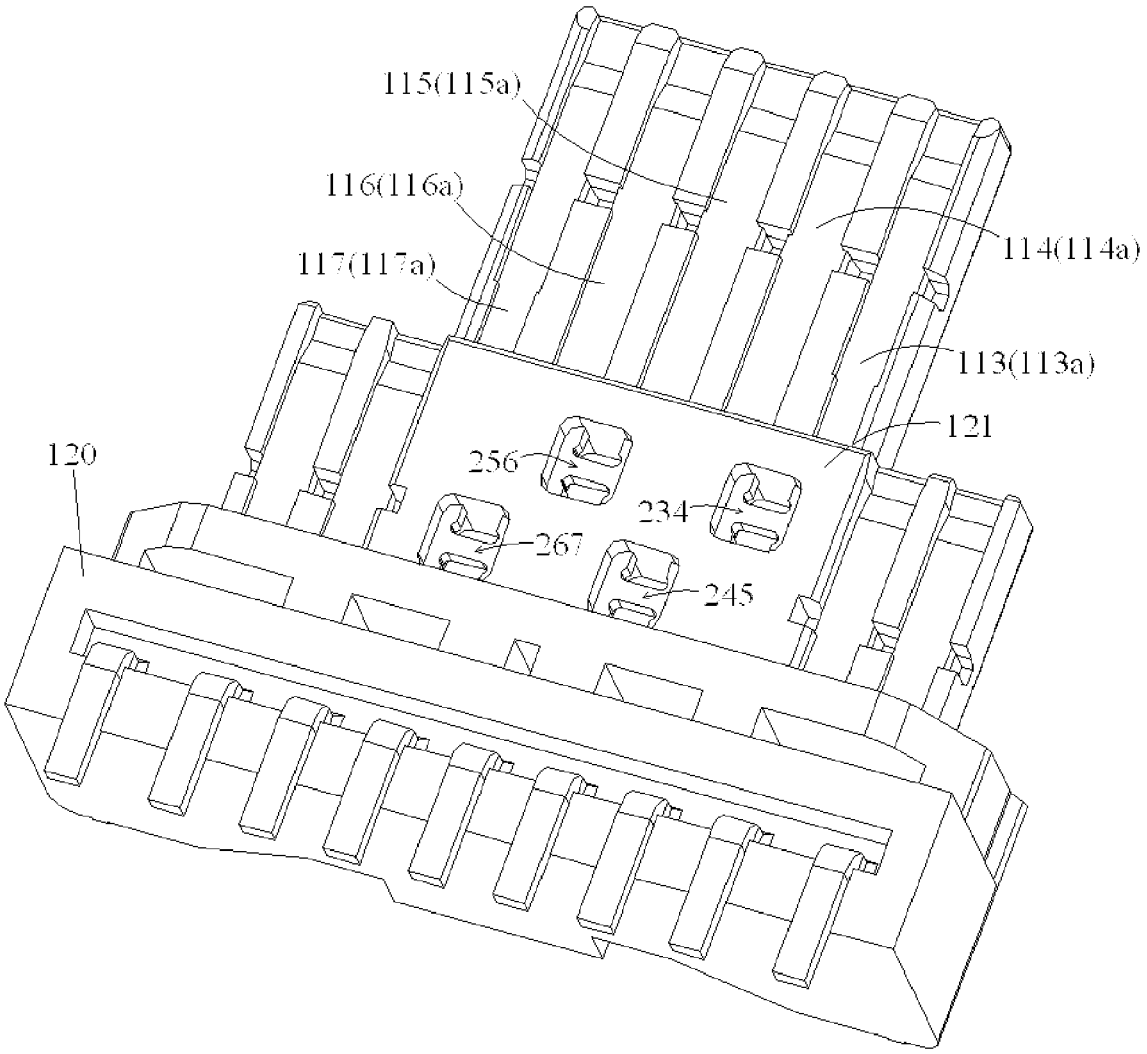
FIG. 4 is another perspective view of the connector of FIG. 3, showing the bridge portions cut and removed.

As shown in FIGS. 3-4, the plurality of bridge portions 134, 145, 156, 167 are positioned between the longer contacts 113 to 117 in order to ensure position accuracy of the five longer contacts 113 to 117 during molding of the insulation body 120 over the five longer contacts 113 to 117. The bridge portions 134, 145, 156, 167 are generally integrally formed between adjacent longer contacts 113 to 117 to connect the adjacent longer contacts 113 to 117 and hold the relative position of the same in the process of manufacturing the five longer contacts 113 to 117.

Furthermore, as shown in FIG. 3, a first bridge portion 134 is formed between adjacent longer contacts 113 and 114, a second bridge portion 145 is formed between adjacent longer contacts 114 and 115, a third bridge portion 156 is formed between adjacent longer contacts 115 and 116, and a fourth bridge portion 167 is formed between adjacent longer contacts 116 and 117.

In an exemplary embodiment of the present invention, as shown in FIG. 3, regions 121 around the bridge portions 134, 145, 156, 167 are covered by the insulation body 120.

Now with reference back to FIG. 3, each contact of the first group of contacts 113 to 117 includes a contact portion 113*a* to 117*a* that is exposed outside the insulation body 120 and a non-contact portion that is covered by the insulation body 120. As shown in FIG. 3, the contact portions 113*a* to 117*a* of the first group of contacts 113 to 117 are exposed outside the insulation body 120 and positioned to electrically connect with respective contacts of another mating connector, as will be described in detail later.

As shown in FIG. 3, the bridge portions 134, 145, 156, 167 are formed between the non-contact portions of the adjacent contacts of the first group of contacts 113 to 117. Accordingly, the bridge portions 134, 145, 156, 167 are positioned away from the contact portions of first group of contacts 113 to 117.

As shown in FIG. 4, a part of the insulation body 120 located at the non-contact portions of the first group of contacts 113 to 117 includes openings 234, 245, 256, 267 to expose the bridge portions 134, 145, 156, 167, which assists in cutting and removal of the bridge portions 134, 145, 156, 167 through the openings 234, 245, 256, 267. After the bridge portions 134, 145, 156, 167 have been cut and removed, the first group of contacts 113 to 117 are electrically isolated from each other.

In the exemplary embodiment shown in FIGS. 3-4, the region 121 around the bridge portions 134, 145, 156, 167 is covered and protected by the insulation material of the insulation body 120, and the contact portions 113*a* to 117*a* that are exposed outside the insulation body 120 are separated from the bridge portions 134, 145, 156, 167 by the insulation material. As a result, during testing the contacts 111 to 119 with nitrous acid, corrosion points are only formed along small incisions produced by cutting the bridge portions 134, 145, 156, 167 and cannot be diffused to the contact portions 113*a* to 117*a* of the contacts 113 to 117 due to the protection of the insulation material around the bridge portions 134, 145, 156, 167. Accordingly, adverse effects on performances of the contacts 113 to 117 are avoided.

As shown in FIGS. 3-4, in an exemplary embodiment of the invention, adjacent bridge portions 134, 145, 156, 167 are staggered by a predetermined distance along a length of the plurality of contacts 111 to 119.

Referring to FIGS. 3-4, in an exemplary embodiment of the invention, the plurality of contacts 111 to 119 each include a contact portion 111*a* to 119*a* exposed outside the insulation body 120 and electrically contacted with another mating connector, and all the contact portions 111*a* to 119*a* of the plurality of contacts 111 to 119 are positioned substantially along the same plane.

Figure 5:
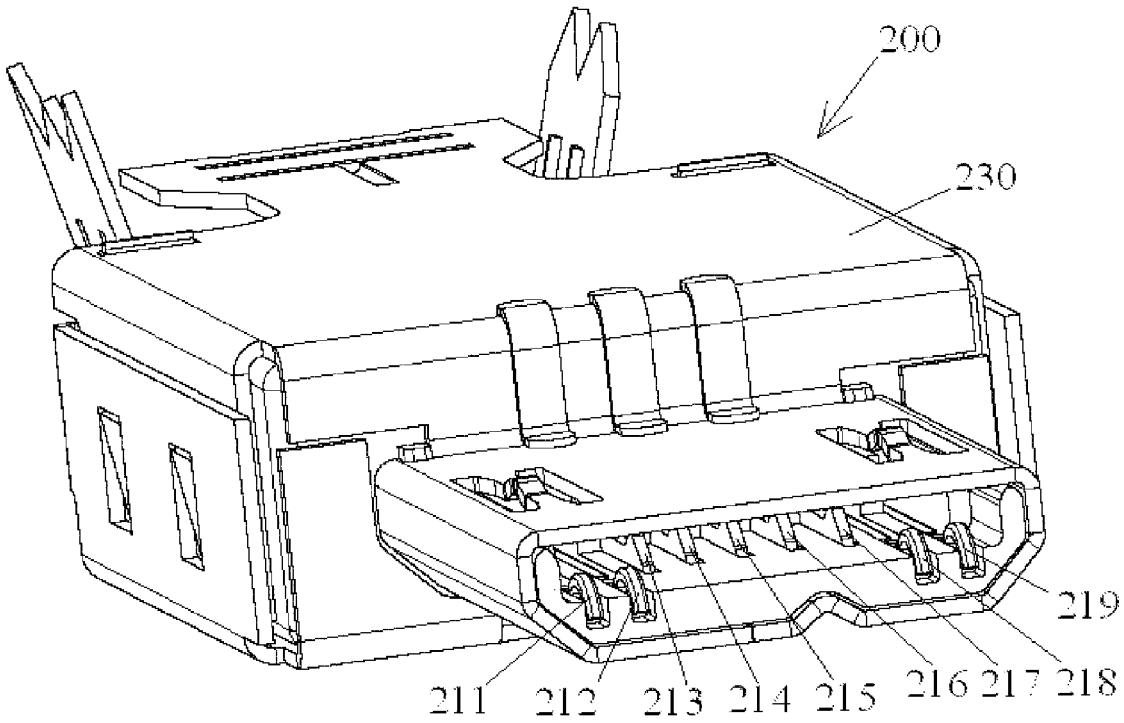
FIG. 5 is a perspective view of another connector mated with the connector of FIG. 1.
Figure 6:
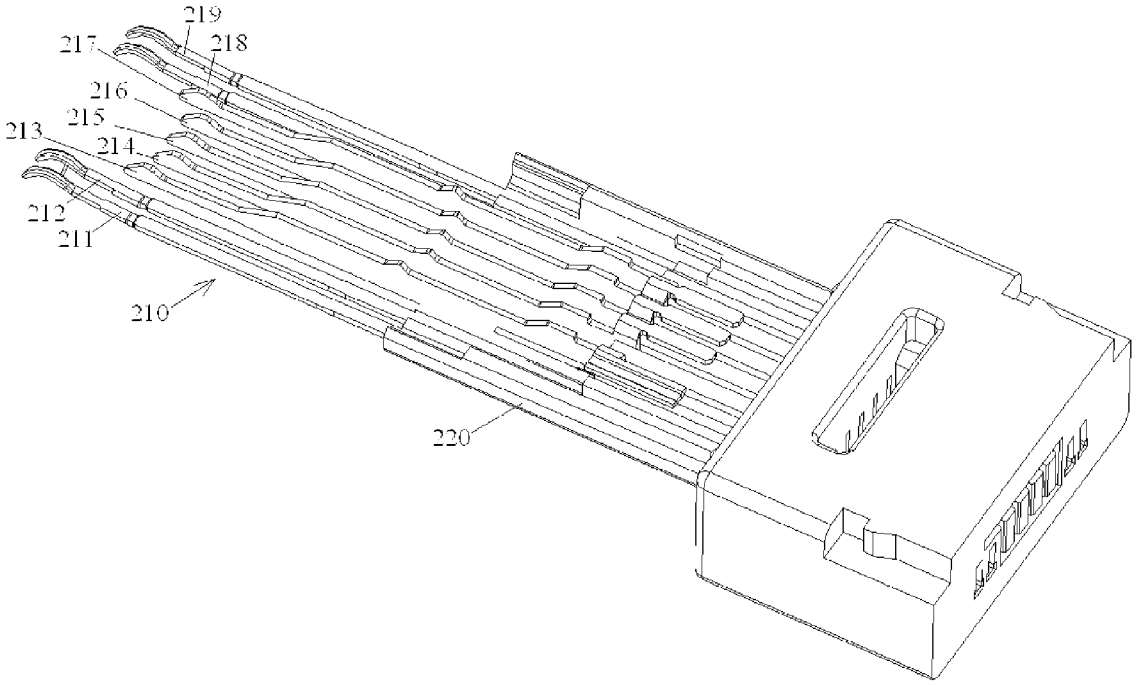
FIG. 6 is a perspective view of the another connector of FIG. 5, in which a shield is removed, and contacts have been arranged on an insulation body, but not have been molded or assembled in the insulation body.

As shown in FIG. 5, another connector 200 is mated with the connector 100 of FIG. 1. As shown in FIG. 6, a shield 230 of another connector 200 is removed.

As shown in FIGS. 5-6, the connector 200 is a plug connector. Correspondingly, the connector 100 shown in FIGS. 1-4 is a receptacle connector. That is, the connector 200 may be inserted into the connector 100 to electrically connect them.

As shown in FIGS. 5-6, the mating connector 200 includes a plurality of mating contacts 211 to 219, an insulation body 220 and a shield 230. The plurality of mating contacts 211 to 219 of the connector 200 correspond to the plurality of contacts 111 to 119 of the connector 100, respectively.

Referring to FIG. 6, a plurality of mating contact receiving grooves (not indicated) are disposed along the insulation body 220. As shown in FIG. 5, the plurality of mating contacts 211 to 219 are received in the plurality of contact receiving grooves, and the shield 230 is enclosed outside the insulation body 220.

Referring to FIGS. 5-6 again, the plurality of mating contacts 211 to 219 includes a first group of mating contacts 213 to 217 for transmitting the first data transmission standard signal and a second group of mating contacts 211, 212, 218, 219 for transmitting the second data transmission standard signal. The second group of mating contacts 211, 212, 218, 219 includes a first pair of differential signal mating contacts 211, 212 and a second pair of differential signal mating contacts 218, 219.

In an exemplary embodiment of the invention, the connector 200 may be compatible with Micro USB (for example, Micro USB 2.0) and USB 3.0 standards. The plurality of mating contacts 211 to 219 include five contacts 213 to 217 for Micro USB and four contacts 211, 212, 218, 219 for USB 3.0.

In the embodiment shown in FIGS. 5-6, two contacts 211, 212 serve as the first pair of differential signal mating contacts 211, 212 for transmitting USB 3.0 signals, and two contacts 218, 219 serve as the second pair of differential signal mating contacts 218, 219 for transmitting USB 3.0 signals.

In the embodiment shown in FIGS. 5-6, the contact 213 serves as a power contact 213 for supplying an electric power to the mixed type of USB connector 200. Two contacts 214, 215 serve as a third differential signal mating contacts 214, 215 for transmitting Micro USB signals, the contact 216 serves as a detection contact 216 for detecting a use state of the connector 200, and the contact 217 serves as a ground contact 217.

As shown in FIGS. 5-6, the plurality of mating contacts 211 to 219 are positioned in one row, and the first pair of differential signal mating contacts 211, 212 and the second pair of differential signal mating contacts 218, 219 are positioned at outmost sides of the first group of mating contacts 213 to 217, respectively.

As shown in FIG. 6, the length of the first and second differential signal mating contacts 211, 212, 218, 219 is longer than the length of other contacts 213 to 217. That is, the length of the five mating contacts for the Micro USB standard is shorter than the length of the two pairs of differential signal mating contacts 211, 212, 218, 219 for the USB 3.0 standard, for example.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector, comprising:

an insulation body having a plurality of contact receiving grooves arranged in a row;

a plurality of contacts disposed in the plurality of contact receiving grooves, being over-molded in the insulation body, and having a first group of contacts and a second group of contacts with a first pair of differential signal contacts and a second pair of differential signal contacts disposed at both sides of the first group of contacts, respectively; and a plurality of bridge portions connecting adjacent contacts of the first group of contacts.

2. The connector according to claim 1, wherein the plurality of contacts are data transmission signal contacts.

3. The connector according to claim 2, further comprising a shield surrounding the insulation body.

4. The connector according to claim 1, wherein the first group of contacts correspond to a Micro USB signal standard.

5. The connector according to claim 4, wherein the second group of contacts correspond to a USB 3.0 signal standard.

6. The connector according to claim 1, wherein the first group of contacts includes a power contact, a third pair of differential signal contacts, a detection contact, and a ground contact.

7. The connector according to claim 1, wherein each of the first group of contacts have a first length that is different from a length of the second group of contacts.

8. The connector according to claim 7, wherein the first length is larger than the length of the second group of contacts.

9. The connector according to claim 1, wherein the insulation body covers a portion of the plurality of contacts connecting to the plurality of bridge portions.

10. The connector according to claim 1, wherein the plurality of bridge portions are exposed through a plurality of openings in the insulation body.

11. The connector according to claim 10, wherein the plurality of bridge portion are removable such that the first group of contacts are electrically isolated from each other.

12. The connector according to claim 11, wherein each contact of the first group of contacts includes a contact portion extending outside the insulation body.

13. The connector according to claim 12, wherein adjacent bridge portions are staggered by a predetermined distance along a length of the plurality of contacts.

14. The connector according to claim 13, wherein each contact portion corresponds along a common plane.

15. The connector according to claim 1, wherein the connector is a receptacle connector being mateable with a mating plug connector having a plurality of mating contacts corresponding to the plurality of contacts.

16. The connector according to claim 15, wherein the plurality of mating contacts include a first group of mating contacts and a second group of mating contacts having a first pair of differential signal mating contacts and a second pair of differential signal mating contacts positioned on opposite sides of the first group of mating contacts, respectively.

17. The connector according to claim 16, wherein the first group of mating contacts have a greater length than a length of the second group of mating contacts.

* * * * *